US005475996A

United States Patent [19]

Chen

[11] Patent Number: 5,475,996

[45] Date of Patent: Dec. 19, 1995

[54] ELECTROMAGNETIC DOOR LOCK

[76] Inventor: Tsun-Hsing Chen, Suite 1, 11 Fl. No. 95-8, Chang Ping Road, Sec. 1, Taichung, Taiwan

[21] Appl. No.: 250,839

[22] Filed: Aug. 29, 1994

[51] Int. Cl.[6] ..... E05B 47/00

[52] U.S. Cl. ..... 70/279; 70/278; 70/277; 70/473; 70/218

[58] Field of Search ..... 70/277–279, 283, 70/218–220, 473, 276

[56] References Cited

U.S. PATENT DOCUMENTS

| | | | |
|---|---|---|---|
| 3,336,770 | 8/1967 | Parsons | 70/277 |
| 4,820,330 | 4/1989 | Lin | 70/278 |
| 4,956,984 | 9/1990 | Chi-Cheng | 70/277 |
| 5,018,375 | 5/1991 | Tully | 70/218 |
| 5,083,122 | 1/1992 | Clark | 70/278 |

*Primary Examiner*—Peter M. Cuomo
*Assistant Examiner*—Tuyet Pham

[57] ABSTRACT

An electromagnetic door lock comprises generally a rectangular housing, a locking mechanism, a pair of electromagnetic components enclosed therein by a front cover and a rear cover. The front cover has a keypad and a transverse slot on an upper portion connected with an identification circuit therein. The electromagnetic component include an actuation assembly and a shift assembly, each having a movable rod opposed to each other. When a code is inputted via the keypad or the transverse slot, the identification circuit therein will transmit an electric current to the actuation assembly for and creating a magnetic field therein to disengageably force the movable rod of the shift assembly to move backward to unlock a door.

6 Claims, 6 Drawing Sheets

ELECTROMAGNETIC DOOR LOCK

BACKGROUND OF THE INVENTION

The present invention relates to door locks, more particularly to a structurally improved electromagnetic door lock in which the movable components are disengageable so as to save the electricity and to prevent the lock from the mechanical abrasion.

Prior art electronic door locks are most likely employing an electronic circuit in a conventional door lock to actuate the electromagnetic components therein on or to obtain the locking or unlocking of a door. Such door locks may be either unlocked manually or electronically by inputting a secret code on a keypad or an identification card inserting into a slot therein. Moreover, such door lock may connect with a security system for preventing from the burglary or recording the personnel entrance in a big firm.

However, once a secret code is inputted, the electronic circuit therein must supply continuously the electricity to the electromagnetic components in order to maintain the door lock in a state reliable to unlock at anytime, therefore, causing the electric consumption; Besides, the electromagnetic components therein are engageable with each other, it is unavoidable that they will be abraded under frequent pushing and budging, thus, reducing the reliability and the durability of the components.

Furthermore, if such door lock employs an electric-saving device such that the electricity may cut off after every unlocking movement and the door is automatically locked after the passage of a person, it is unapt for a big place such as an office or a factory where the personnel entrance are very frequent.

SUMMARY OF THE PRESENT INVENTION

The present invention has a main object to provide an electromagnetic door lock in Which the electromagnetic components are disengageable with each other for preventing the component from abrasion in order to maintain the door lock to be reliable and durable.

Another object of the present invention is to provide an electromagnetic door which needs only a transient supply of the electricity to maintain a state for reliable to unlock until the next input of a code for locking up, therefore, saving the electricity and facilitating the personnel entrance.

Accordingly, the electromagnetic door lock of the present invention comprises generally a rectangular housing having a conventional locking mechanism therein, a front cover and a rear cover thereof.

The front cover has a keypad and a transverse slot including an identification circuit plate therein on the upper portion, a circular hole on median portion for receiving a conventional keyhole from the locking mechanism, and a handle on the lower portion thereof.

The present invention is characterized in a pair of the electromagnetic components which comprises an actuation assembly and a shift assembly disposed therein. Each has a magnet at the end of a movable rod on relative sides of them apposing to each other. The actuation assembly has a coil therein electrically connected with the identification circuit of the keypad and the shift assembly is mechanically connected with the handles of the two covers and the locking mechanism via an elongate rectangular shaft.

When the actuation assembly is fluxed with electric power, an electromagnetic field is occurred therein to force the first movable rod thereof moving forward to indirectly push the second movable rod of the shift assembly to move backward as to unlock the door lock immediately and the door remains openable after the cut-off of the electricity, until the next inputting of a code of door-locking that the first and second movable rods of the electromagnetic components return back to their original positions as to lock the door again. This arrangement provides an advantage of saving the electricity.

A positioning device comprises a crescent slot, a pair of spaced screw holes and a retaining pin on the shift assembly facilitating the door lock of the present invention to be positioned at right or left side of a door.

The present invention will become more fully understood by reference to the following detailed description thereof when read in accompanying with the attached drawings.

DETAIL DESCRIPTION OF THE PREFERRED EMBODIMENT OF THE PRESENT INVENTION

Figure 1:
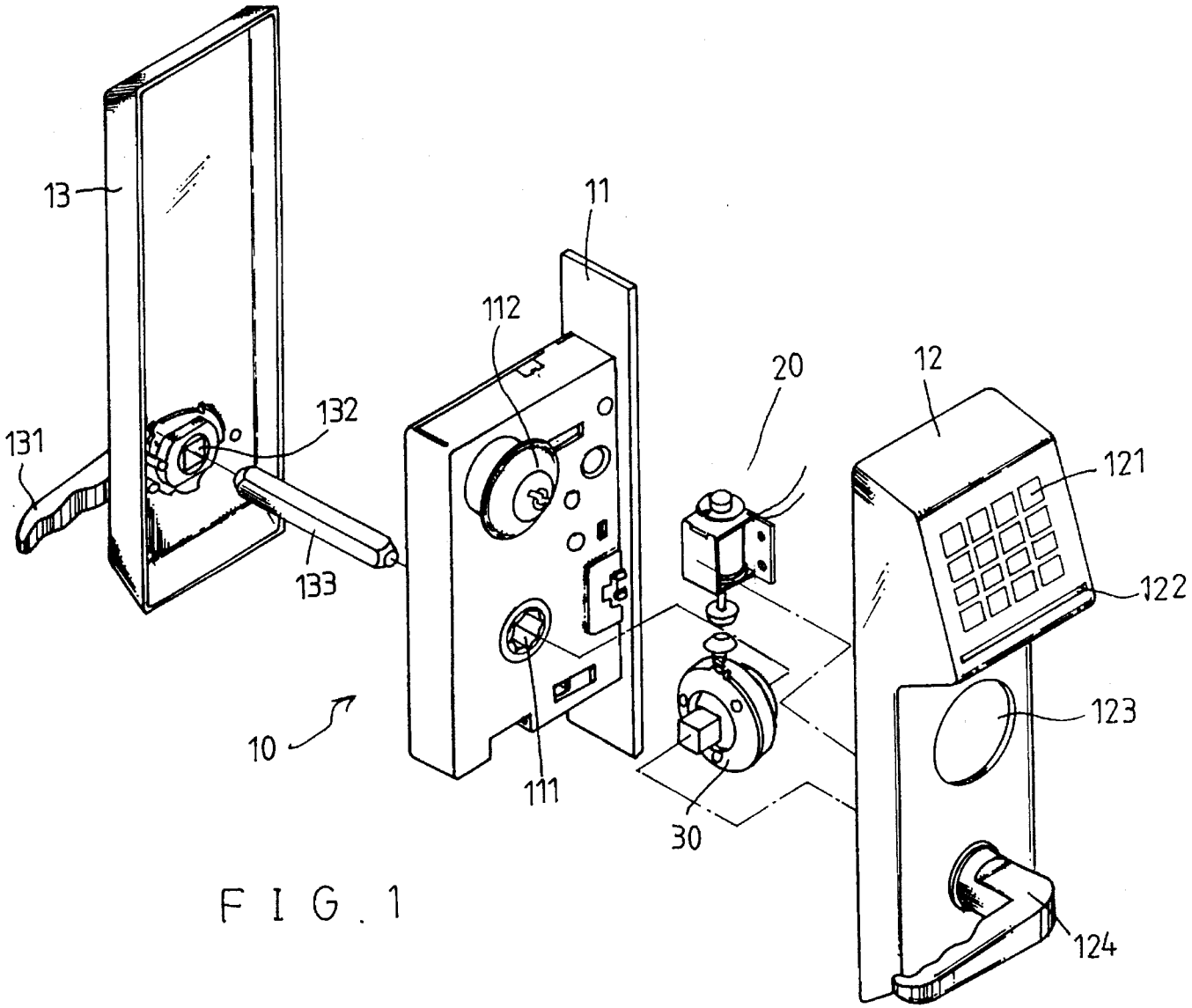
FIG. 1 is an exploded perspective view to show the preferred embodiment of the present invention.

With reference to FIG. 1 of the drawings, the electromagnetic door lock of the present invention comprises generally a rectangular housing 10 having a front cover 12, a rear cover 13, a conventional looking mechanism 11, an actuation assembly 20 and a shift assembly 30 enclosed therein.

The locking mechanism has a square. passage 111 on lower portion, a conventional keyhole 112 on upper portion and a set of latch means (not shown) enclosed therein.

The front cover 12 has a keypad 121 adjacent a transverse slot 122 including anidentification circuit therein on a protruded, sloped upper portion, a circular hole 123 on a median portion for receiving the keyhole therein and a handle 124 swivelably secured on a lower portion including a square recess (dot shown) at the interior end thereof.

The rear cover 13 has a corresponding handle 131 swivelably secured on a lower portion including a square recess 132 at the interior end for securing an elongate rectangular shaft 133 therein.

Figure 2:
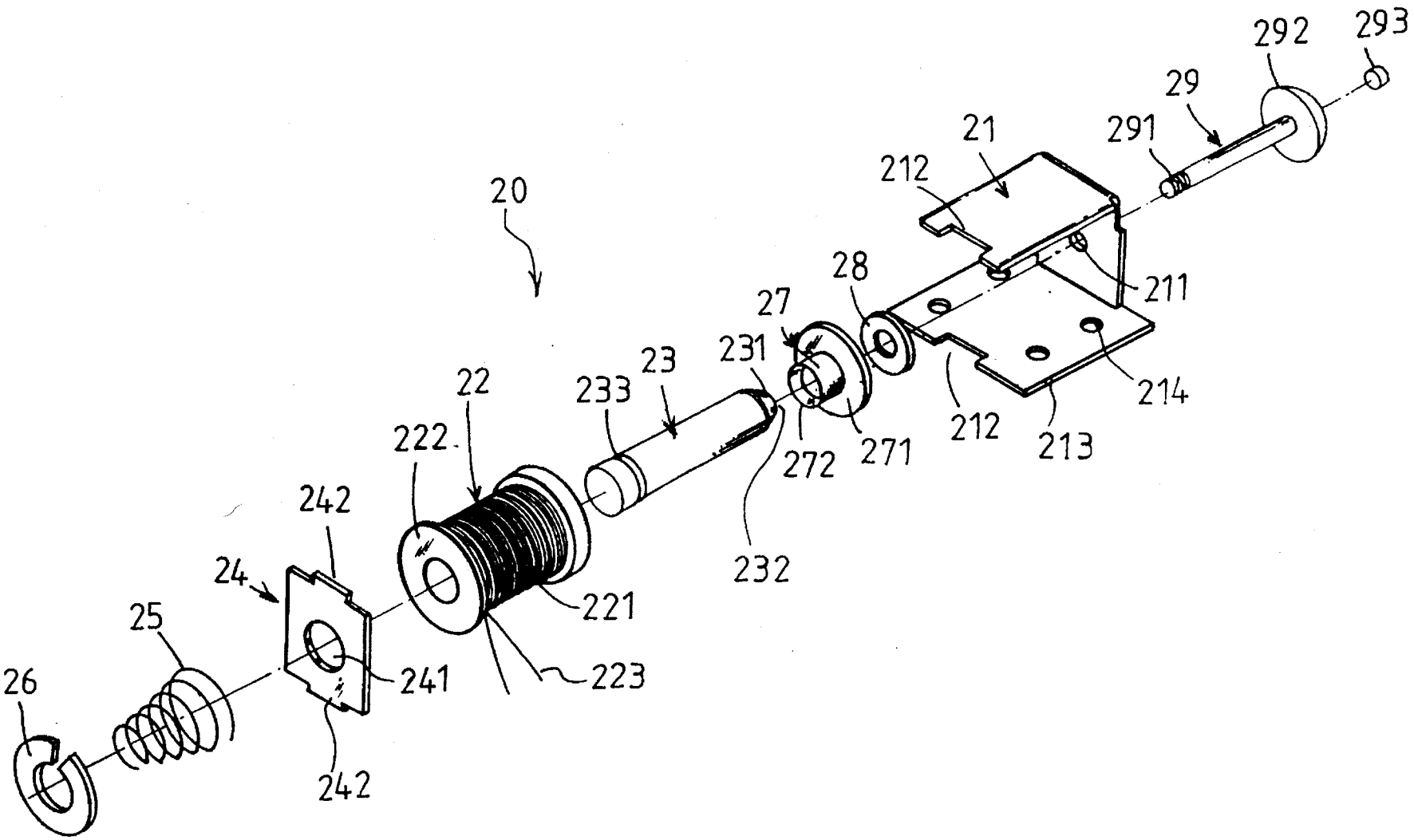
FIG. 2 is an exploded perspective view to show an actuation assembly of the electromagnetic door lock according to the present invention.

Referring to FIG. 2, the actuation assembly 20 comprises an U-shaped casing 21, a field coil 22, a pushing shaft 23, a rectangular cover 24, a conical coil spring 25, a retaining ring 26, a cap shaped sleeve 27, an annular magnet 28 and a first movable rod 29.

The casing 21 has an axial aperture 211 centrally formed on the transverse portion of the U-shape, a pair of indentures 212 formed respectively at the ends of the perpendicular portions of the U-shape and a pair of the flanges 213 extended outward from the lateral sides of the lower perpendicular portion including a pair of the screw holes 14 formed thereon for securing to the inner wall of the front cover 12.

The field coil 22 is composed of a coil 221 wound on a non-conductive tube 222 and connected on the two ends 223 with the identification circuit in the front cover 12.

The pushing shaft 23 which is made of the magnaflux material comprises a cylindrical body of a length longer than the field coil 22, an outer diameter slightly smaller than the inner diameter of the tube 222, a tapered head 231 at fore end including an axial recess 232 at the center of the head 231 and an annular groove 233 formed adjacent the rear end thereof. The axial recess 232 has a threaded inner periphery for securing the movable rod 29 therein when assembling.

The rectangular cover 24 has a central aperture 241 and a pair of the protrusions 242 extended outward from the upper and the lower edges respectively, having the size equal to the indentures 212 of the casing 21.

The cap shaped sleeve 27 has a circular body 271 with a central aperture and a tubular neck 272 projected outward from the circumference of the aperture. The circular body 271 has a diameter equal to the tube 222 and the neck 272 has a diameter equal to that of the pushing shaft 23.

The first movable rod 29 which is made of non-magnetic material has at a first end a threaded outer periphery 291 and the second end a domed head 292 having at center thereof a recess for retaining a magnet 293 therein.

The assemblage of the actuation assembly 20 is firstly inserting the pushing shaft 23 through the field coil 22 with two ends thereof slightly exposed out of the coil 22, then wraps sequentially the cap 27 and annular magnet 28 on the tapered head 231 of the shaft 23 before the alignment with the axial aperture 211 of the casing 21 for facilitating the securement of the first movable rod 29 to the axial recess 232 of the pushing shaft 23, and then wraps the cover 24 on the rear end of the shaft 23 with the protrusions 242 thereof engaged with the pair of the indentures 212 of the casing 21 therein before fixed by the conical coil spring 25 and the retaining ring 26 which is inlaid in the annular groove 233 of the pushing shaft 23.

Figure 3:
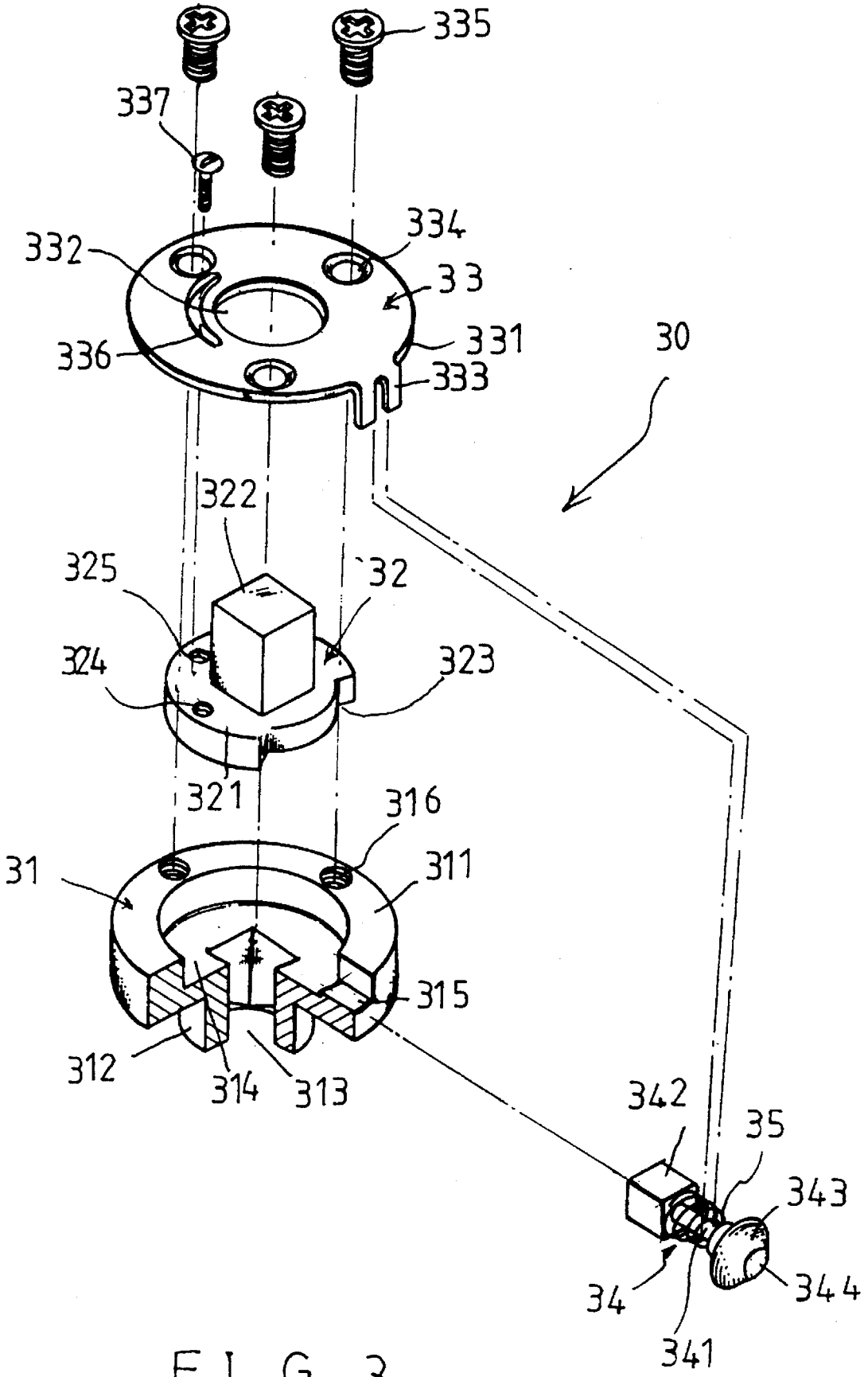
FIG. 3 is an exploded perspective view to show a shift assembly of the electromagnetic door lock according to the present invention.

Referring to FIG. 3 of the drawings, the shift member 30 comprises a cap shaped seat 31, a circular rotary means 32, a circular cover 33, a second movable rod 34 and a conical spring 35 thereof.

The cap shaped seat 31 has an encircled wall 311 projected upward from the circumference defining a circular receiving space 314 therein, a cylindrical neck 312 integrally and concentrically protruded downward from the bottom including a square recess 313 formed through the center thereof, an opening 315 formed on a periphery of the wall 311 and a plurality of screw holes 316 spacedly formed around the top of the wall 311.

The rotary means 32 has a circular body 321 having a diameter slightly smaller than that of the receiving space 314, a rectangular protrusion 322 projected upward from the center thereof, a peripheral indenture 323 formed on a circumference which occupies about a quadrant of the circular body 321 thereof and a pair of the screw holes 324 and 325 spacedly and vertically formed adjacent a circumference thereof at the predetermined positions which is provided for facilitating a directional alteration of the door lock.

The cover 33 has a circular body 331 diametrically equal to that of the seat 31, a circular aperture 332 concentrically formed on the center thereof which has a diameter to allow the rectangular protrusion 322 of the rotary means 32 free to pass and to rotate therein, a clamping lug 333 extend downward from a circumference thereof, a plurality of screw holes 334 spacedly formed in cooperation with a plurality of the screws 335 adjacent the periphery thereof which their positions are in registry with the screw holes 316 of the seat 31 and a crescent slot 336 formed adjacent the circular apertures 332 which is provided in cooperation with a smaller screw 337 and the pair of the crew holes 324 and 325 of the rotary means for positioning purpose.

The second movable rod 34 which is made of non-magnetic permanent material has a cylindrical body 341, a square catch 342 formed at a first end thereof and a second end a domed head 343 at the center of which a magnet 344 is inlaid therein, and the conical coil spring 35 biased on the rod 34 in between the catch 342 and the domed head 343.

The assemblage of the shift assembly 30 is firstly to movably embed the circular rotary means 32 into the circular space 314 of the seat 31 with the rectangular protrusion 322 thereof toward upward, then, inserts the square catch 342 of the second movable rod 34 into the opening 315 of the seat 31 as the coil spring 35 remaining outside the seat 31, and then closes the cover 33 onto the upper rim of the seat 31 so as to keep the cylindrical body 341 of the second movable rod 34 to be restrained in between the legs of the lug 333 and the inner end of the conical coil spring 35 stopped against the outer surface of the lug 333 and the outward surface of the square catch 342 stopped against the inner surface of lug 333, finally, secures by the plurality of the screws 33 5. Meanwhile, the smaller screw 337 is secured, via the crescent slot 336 into any of the two screw holes 324 or 325 of the rotary means 32 so as to facilitate the users for their directional adjustment at the later stage.

Figure 4:
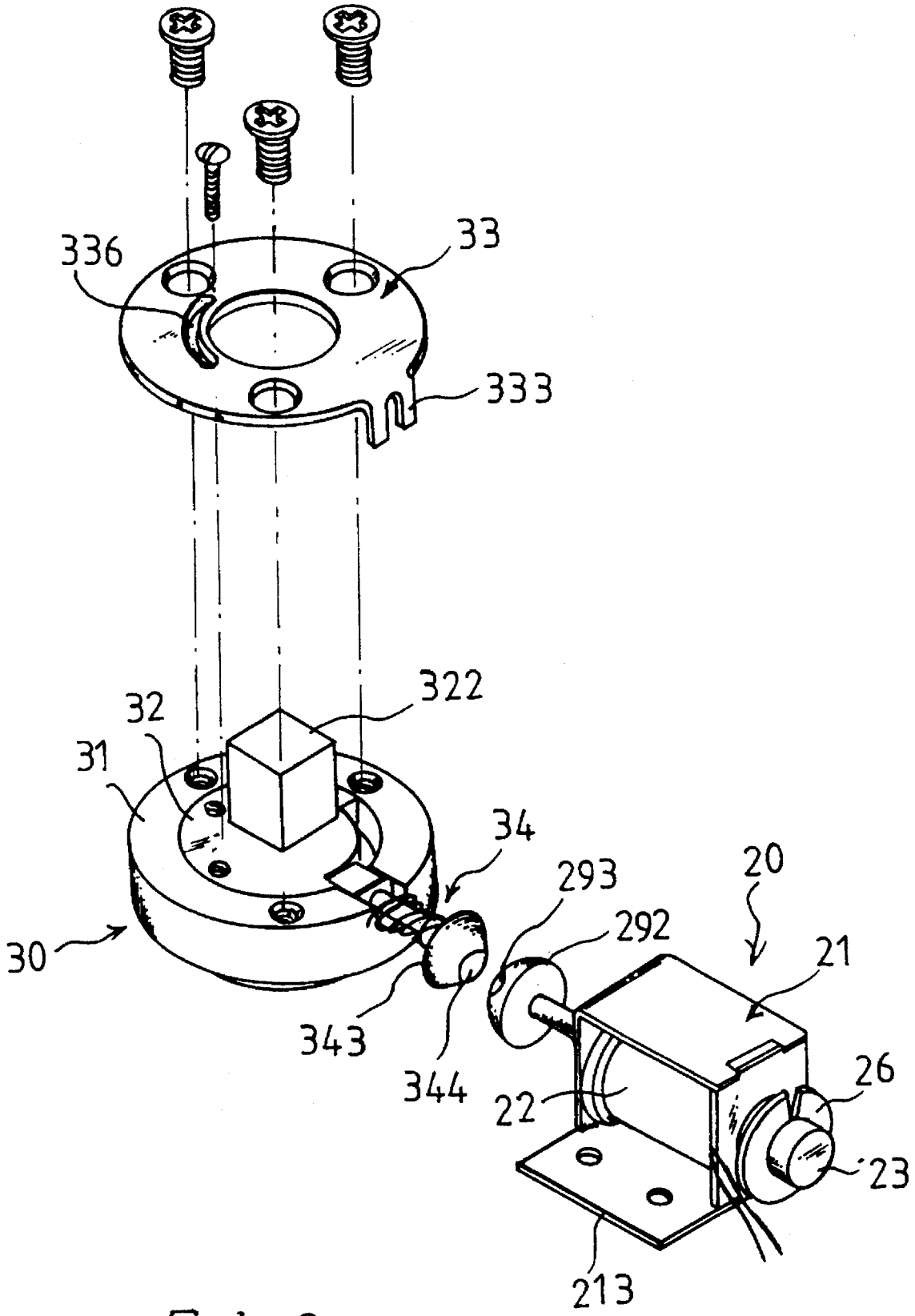
FIG. 4 is an exploded perspective view to show the relative portions of the actuation assembly and the shift assembly of the electromagnetic door lock according to the present invention.

Referring to FIGS. 1 and 4 of the drawings, the assemblage of the electromagnetic door lock of the present invention simply follows the following process: Firstly, screw secures the actuation assembly 20 to the inner wall of the front cover 12 at a predetermined position and direction and connects the cords thereon with the identification circuit under the keypad 121, then fixes the elongate rectangular shaft 133 at a first end into the square recess 132 and a second end into the square recess 313 of the cap shaped seat 31 after[i] passing through the square passage 111 of the locking mechanism 11, then, secures the rectangular protrusion 322 into the square recess at the interior end of the handle 124 of the front cover 12 so as to allow the two covers 12 and 13 to be tightly closed up is snap fitting. Where, the two domed heads 292 and 343 of the actuation assembly 20 and the shift assembly 30 must direct to each other in a predetermined distance (as shown in FIG. 4) and the conventional keyhole 112 exposes within the circular hole 123. So that the electromagnetic door lock of the present invention may be operable during a power failure.

FIGS. 2, 4, 5A and 5B illustrate the function of the electromagnetic components of the present invention. When the door lock is in the locking state, there is no electromagnetic field created therein because of no flux of electricity. So that the two conical coil springs 25 and 35 are operable and resiliently forces the domed head 292 of the actuation assembly to move backward to stop against thee outer wall thereof and the square catch 342 of the shift assembly 30 moving outward and disengageable with the peripheral indenture 323 of the rotary means 32, so as to allow the rotary means to rotate freely inside the cap shaped seat 31 and the handle 124 of the front cover 12 can not open the door because it solely connects with the rotary means 32. Only the handle 131 of the rear cover 13 can open the door for it is always engageable with the locking mechanism 11 via the elongate rectangular Shaft 133.

When a code is inputted on the keypad 121 or by a identification card, the identification circuit therein will accordingly transmit electric power to the actuation assembly 20 and a magnetic field, under left-hand rule, creates simultaneously around the field coil 22 that affects the pushing shaft 23 to be magnetized and attracted by the annular magnet 28 therein, so as to push the first movable rod 29 to move forward toward the second movable rod 34 of the shift assembly 30. The magnet 293 at the top center of the domed head 292 thereof will disengageably repel the equivalent magnet 344 at top center of the domed 343 and thus forces the second movable rod 34 to move backward and the square catch 342 thereof entering into the cap shaped seat 31 and engageable with the indenture 323 of the rotary means 32 which is now checked from rotation (as shown in FIG. 4). So that the handle 124 of the front cover 12 is now engageable with the elongate rectangular shaft 133 via the shift member 30 and opens the door readily.

Figure 5A:
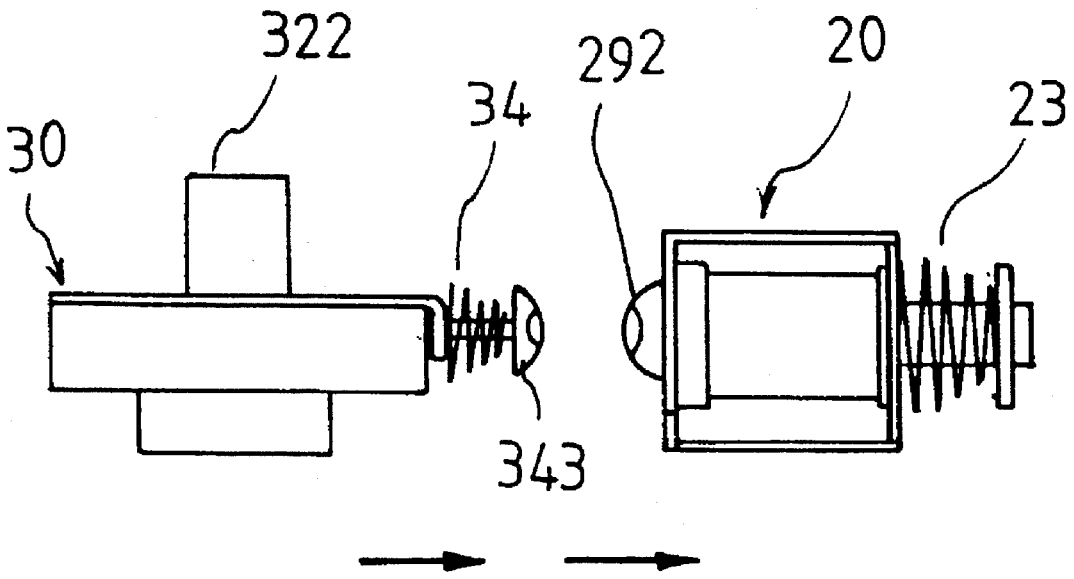
FIGS. 5A and 5B are the side views to indicate the actuation assembly and the shift assembly in operation.

Once the pushing shaft 2 3, the cap shaped sleeve 27 and the annular magnet 28 are attracted to attach together in the U-shaped casing 21, they will into separate immediately after the cut-off of the electric power, until another code is inputted ordering the identification circuit to transmit an inverse current to the field coil 22 for creating, under the left-hand rule, a reverse electromagnetic field therein, in order to affect the pushing shaft 23 to be magnetized in reverse direction that repels the annular magnet 28 so as to be forced, in association with the resilient force of the spring 25 to pull the first movable rod 29 back to the original position and the second movable rod 34 is resiled back also by the spring 35 of the shift assembly 30 to disengage the square catch 342 with the indenture 323 of the rotary means 32 from therein (as shown in FIG. 5A).

Figure 5B:
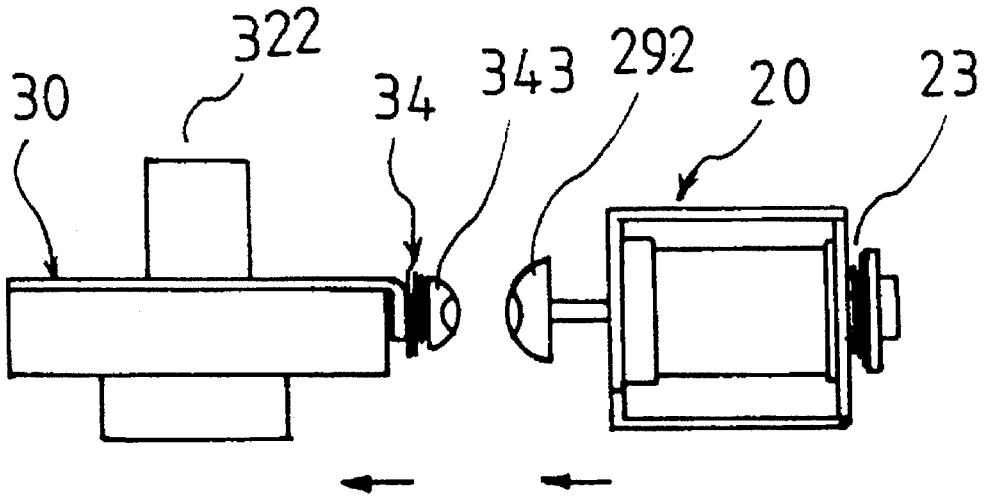

So that the square catch 342 can be engaged with the rotary means 32 any longer (as shown in FIG. 5B) until an inverse current is transmitted from the identification circuit and the handle 124 of the front cover 12 can operate the locking mechanism to open the door as long as the square catch 342 is engageable with the rotary means 32. This arrangement provides a great advantage of saving electricity and facilitates the users for their optional operations.

Figure 6A:
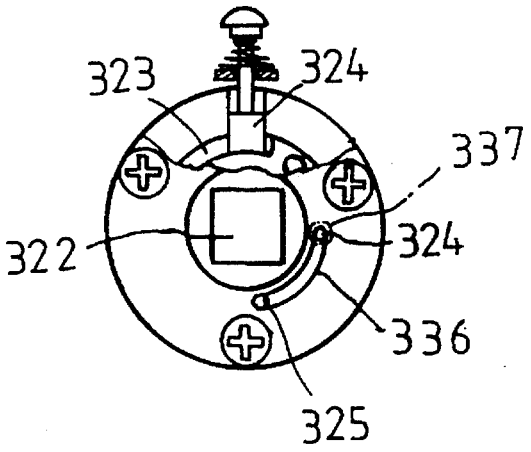
FIGS. 6A and 6B are the top views to illustrate the positioning device of the shift assembly performing the directional alteration.
Figure 6B:
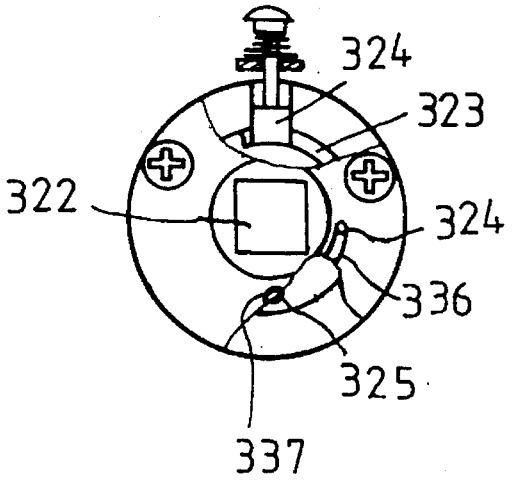

Referring to FIGS. 6A and 6B, which show a positioning device on the shift member 30. FIG. 6A shows apparently that the smaller screw 337 secures, via the crescent slot 336, to the first screw hole 324 and the right side of the square catch 342 abutting the right end of the peripheral indenture 323 (relative to the top of the rectangular protrusion 322 of the rotary means 32. That the rotary means 32 is restricted from rotating counterclockwise, so as to facilitate the door lock of the present invention to be positioned at the right side of a door (relative to the front side of the door). If the smaller screw 337 secures to the second screw hole 325 therein, (as shown in FIG. 6B) the rotary means 32 is inversely restricted from rotating clockwise, so as to facilitate the door lock to be positioned at the left side of a door. Since that the rotary means 32 is embedded in the shift member 30, it is difficult for the user to find out the right position of the peripheral indenture 323 therein. This arrangement solves the problem because of that the users can readily find the right direction from the crescent slot 336 therein rather than that to open the cover 33 of the shift member 30.

Furthermore, the structure of the peripheral indenture 323 of the rotary means 32 incorporated with the square catch 342 of the second movable rod 34 are still operable even after a joint deformation of the handle 124 on the front cover 12 thereof, a metallic fatigue of the spring for example, thus increases the intensity of the door lock of the present invention.

Based an aforediscussed structure, the present invention provides numerous features and advantages outlined as follows:

a) the electromagnetic: device therein adapting the repellent property of the magnetism will prevent the components thereof from a mechanical abrasion, b) both the first and the second movable rods thereof are made of the non-magnetic permanent material that will not be attachable to other components therein so as to provide a smooth operation, and c) a conventional keyhole reserves therein that provides optional operation to the users.

Note that the specification relates to the above embodiment should be construed as to examplary rather than as limitative of the present invention, with many variations and modifications being readily attainable by a person of average skill in the art without aparting from the spirit or scope thereof as defined by the appended claims and their legal equivalents.

I claim:

1. An electromagnetic door lock comprising:

a rectangular housing, a front cover, a rear cover, a locking mechanism and a pair of electromagnetic elements slidingly enclosed therein by said cover;

said locking mechanism comprising a keyhole adjacent a rectangular passage transversely across from said mechanism and a set of latch means disposed therein;

said front cover comprising a keypad adjacent a transverse slot having an identification circuit therein on an upper portion thereof, a circular hole on a median portion thereof for receiving said keyhole therein and a handle rotatably secured to a lower portion thereof having a square recess formed at a inner end therein;

said rear cover comprising a handle rotatably secured to a position in registry with said handle of said front cover having also a square recess formed at the inner end therein;

said electromagnetic elements comprising an actuation assembly secured to a predetermined position on a interior wall of said front cover and electrically connected with said identification circuit and a shift assembly axially connected on a first end with said handle of said rear cover, via an elongate rectangular shaft and a second end of said shift assembly connected to said handle of said front cover via said square recess thereof;

said actuation assembly comprising a U-shaped casing, a rectangular cover, a tubular field coil slidingly telescoped onto a cylindrical pushing shaft which is longer than said field coil and wrapped on a first end by a cap shaped sleeve and an annular magnet and connected with a first movable rod via an axial aperture centrally formed through a transverse portion of said U-shaped, and a second end telescoped by said rectangular cover and secured by a conical coil spring and a retaining ring;

said shift assembly comprising a cap shaped seat having an encircled circumferential wall projected upward including an opening formed on a periphery and a plurality of screw holes spacedly formed around the top rim of said wall and a cylindrical neck concentrically formed and protruded downward from the bottom thereof including a square recess centrally formed therein, a rotary means having a circular body and a peripheral indenture on a circumference, said rotary means further comprising a pair of screw holes vertically formed adjacent an opposing circumference thereof and a rectangular protrusion concentrically formed and projected upward from the top thereof; said shift assembly further comprising a circular cover having a clamping lug extended downward from a circumference thereof, a concentrical circular hole, a crescent slot and a plurality of screw holes respectively formed on the planar portion thereof and a second movable rod having a square catch at a first end and a domed head including a centrally inlaid magnet at a second end thereof; said rotary means having been movably embedded with said cap shaped seat and covered by said circular cover thereon and secured by a plurality of screws; said second movable rod having been slidingly restricted by said clamping lug on said square catch in said opening of said cap shaped seat and biased by a conical coil spring thereon;

whereby, said first movable rod of said actuation assembly, by means of magnetism slidingly and disengageably forces said second movable rod of said shift assembly to move inward, upon a transmission of electric power from said identification circuit to check said rotary means from rotation so as to facilitate said handle of said front cover to be engageable with said locking mechanism of said door lock for opening a door.

2. An electromagnetic door lock according to claim 1, wherein said pushing shaft has an annular groove adjacent said second end for securing said retaining ring therein and said first end a tapered head having a centrally formed screw hole for securing said first movable rod therein.

3. An electromagnetic door lock according to claim 2, wherein said first movable rod has a threaded periphery at a first end and a domed head witch a magnet centrally inlaid therein at a second end thereof.

4. An electromagnetic door lock according to claim 1, wherein said circumferential indenture of said rotary means has a length occupying about a quadrant of said rotary means.

5. An electromagnetic door lock according to claim 1, further has a smaller screw in cooperation with said other screws in said rotary means for selectively altering the rotating directions of said circumferential indenture.

6. An electromagnetic door lock according to claim 1, further has a conventional keyhole thereof reserved for optional operation.

* * * * *